US008506465B2

(12) United States Patent
Terhaag et al.

(10) Patent No.: US 8,506,465 B2
(45) Date of Patent: Aug. 13, 2013

(54) METHOD AND AN APPARATUS FOR FOLDING A MEDIUM

(75) Inventors: Michiel A. C. Terhaag, Melick (NL); Jeroen A. A. Van Assen, Waalre (NL)

(73) Assignee: OCE-Technologies B.V., Venlo (NL)

( * ) Notice: Subject to any disclaimer, the term of this patent is extended or adjusted under 35 U.S.C. 154(b) by 829 days.

(21) Appl. No.: 11/783,066

(22) Filed: Apr. 5, 2007

(65) Prior Publication Data

US 2007/0238596 A1 Oct. 11, 2007

(30) Foreign Application Priority Data

Apr. 7, 2006 (EP) ..... 06112388

(51) Int. Cl.
*B31B 1/10* (2006.01)

(52) U.S. Cl.
USPC ..... 493/417; 493/416; 493/435; 493/454

(58) Field of Classification Search
USPC ..... 493/405, 442, 408–410, 416–417, 493/419, 424, 434–435, 454
See application file for complete search history.

(56) References Cited

U.S. PATENT DOCUMENTS

| | | | | |
|---|---|---|---|---|
| 3,747,917 | A * | 7/1973 | Roda | 493/14 |
| 3,809,387 | A | 5/1974 | Heist et al. | |
| 4,484,905 | A * | 11/1984 | Ashburner | 493/415 |
| 5,047,003 | A * | 9/1991 | Schmidlin et al. | 493/413 |
| 5,067,305 | A * | 11/1991 | Baker et al. | 53/411 |
| 5,344,379 | A | 9/1994 | Garrone | |
| 5,551,939 | A * | 9/1996 | Deckers | 493/442 |
| 6,186,501 | B1 | 2/2001 | St. Ours | |
| 6,353,726 | B1 * | 3/2002 | Murata et al. | 399/407 |
| 6,569,074 | B2 * | 5/2003 | Bluemle | 493/245 |
| 6,980,766 | B2 | 12/2005 | Ito | |
| 7,063,472 | B2 | 6/2006 | Matsuda et al. | |
| 2001/0007618 | A1 | 7/2001 | Kawachi et al. | |
| 2004/0048727 | A1 * | 3/2004 | Roozrokh | 493/424 |
| 2005/0012259 | A1 | 1/2005 | Sano et al. | |
| 2006/0180970 | A1 * | 8/2006 | Mimura et al. | 270/32 |

FOREIGN PATENT DOCUMENTS

| | | | |
|---|---|---|---|
| CN | 1403880 | A | 3/2003 |
| CN | 1533972 | A | 10/2004 |
| DE | 10 2005 017 231 | A1 | 10/2006 |
| EP | 0 379 712 | B1 | 12/1989 |
| EP | 0 590 359 | A1 | 4/1994 |
| EP | 0 645 335 | A1 | 3/1995 |
| EP | 0 856 776 | A2 | 8/1998 |
| EP | 1 369 367 | A2 | 12/2003 |

(Continued)

*Primary Examiner* — Christopher Harmon
(74) *Attorney, Agent, or Firm* — Birch, Stewart, Kolasch & Birch, LLP

(57) ABSTRACT

A method and apparatus for folding a medium in a folder, which includes a rotatable folding cylinder, a first rotatable press member capable of engaging with said folding cylinder to form a first folding pinch, a second rotatable press member capable of engaging with said folding cylinder to form a second folding pinch, and a medium feed means, wherein the medium is fed with the medium feed means towards the folding cylinder between the first and second pinch; b) the medium is then directed into the first folding pinch, formed by engaging said first rotatable press member with said folding cylinder, by rotating the folding cylinder in a first direction; c) a blouse is formed in the medium between said feed means and the folding cylinder; and d) said blouse is moved into said second pinch by rotating the folding cylinder in a second direction, opposite to the first direction.

13 Claims, 9 Drawing Sheets

(56) References Cited

FOREIGN PATENT DOCUMENTS

| | | | |
|---|---|---|---|
| JP | 5-319687 | A | 12/1993 |
| JP | 6-56055 | U | 8/1994 |
| JP | 8-108955 | A | 4/1996 |
| JP | 2000-95407 | A | 4/2000 |

* cited by examiner

METHOD AND AN APPARATUS FOR FOLDING A MEDIUM

This application claims priority from European Patent Application No. 06112388.1 filed on Apr. 7, 2006, the entire contents of which is hereby incorporated by reference in its entirety.

BACKGROUND OF THE INVENTION

The present invention relates to a method for folding a medium. The present invention also relates to an apparatus equipped to execute the folding method as well as a printing system comprising an in-line combination of a print engine and the folding apparatus.

A method of this kind is known from European patent specification EP 0 379 712. This method executes a folding program, during which conveying rollers are driven in a feed direction to advance a web into a conveying pinch. The leading edge of the web is introduced into the pinch over its entire width by guide faces on guide rails. When the folding program is initiated a folding cylinder is driven in a first direction and in the opposite direction, depending on the required folds. When the folding cylinder is driven, the cylinder draws the web into the folder while the conveying pinch itself is freely rotatable in the feed direction but blocked in the reverse direction. When the direction of rotation is reversed, the blocking of the conveying pinch acts as a return stop and prevents the web from moving back. At the reversal of the cylinder's direction a bulge is formed. This bulge is guided into a fold pinch thereby forming a fold in the web. This procedure is repeated until the required folding configuration is reached.

A disadvantage of this known method is that it requires a complex construction with a return stop to prevent the paper web from moving back at the conveying pinch and a complex system of guide faces and guide means to guide the leading edge and formed bulges to form folds in the web. Another disadvantage of this known method and apparatus for executing such method is that the folding cylinder draws the web from the supply, which can put stresses on the web and even affect the integrity of the web.

SUMMARY OF THE INVENTION

The object of the present invention is to provide a method and apparatus for folding a medium with a large range of possible folding programs, while imposing low demands on the complexity of the construction that executes the folding method. In a first aspect of the present invention, a method for folding a medium in a folder is provided, which folder comprises a rotatable folding cylinder, a first rotatable press member, which is capable of engaging with said folding cylinder to form a first folding pinch, a second rotatable press member, which is capable of engaging with said folding cylinder to form a second folding pinch, and a medium feed means, wherein the method comprises the steps of a) feeding the medium with the medium feed means towards the folding cylinder between the first and second pinch; b) directing the medium into the first folding pinch formed by engaging said first rotatable press member with said folding cylinder, by rotating the folding cylinder in a first direction; c) forming a blouse in the medium between said feed means and the folding cylinder; and d) moving said blouse into said second pinch by rotating the folding cylinder in a second direction, opposite to the first direction.

The folder that executes the method according to the present invention is capable of folding the media with a large variety of input dimensions into folded packages with large flexibility in the range of folding programs, while the construction needed to execute this method remains relative simple and small. The amount of necessary path switches and pivoting guides that have to be controlled in order to execute the method according to the invention is small. This enables the method and apparatus for executing the folding to be less complex, less sensitive to errors and smaller, while not reducing the accuracy of the folds.

In one embodiment the method further comprises the steps of forming a second fold in the medium. Therefore, an additional blouse is formed between the feed means and the folding cylinder, before moving said blouse into said first pinch, by rotating the folding cylinder in the first direction. By executing this method an additional fold is made in the medium. Repeating the sequence of making a fold in a first direction followed by a fold in a second direction enables the medium to be fanfolded or folded in a zigzag configuration.

In another embodiment according to the present invention, the folder comprises blouse means disposed upstream of the medium feed means and skew detecting means, the method further comprising the step of correcting for medium skew before folding. The blouse means in the folder introduce a degree of freedom to the medium that is to be folded that can be utilised to align the leading edge of the medium. Aligning the medium before starting the folding procedure enables the folds to be made in the correct angle with respect to the medium. Preferably the medium is aligned such that the folds are applied perpendicular to the side edges of the medium.

In a further embodiment according to the present invention, the step of correcting for the medium skew is executed by the medium feed means. Executing the alignment of the medium by the medium feed means yields a simple solution for aligning the medium perpendicular to the feeding direction of the medium. This step does not introduce extra complexity to the construction that executes the method, as the medium feed means are already drivable to feed the medium.

In a further embodiment of the method according to the present invention, the skew correction is executed by driving the feed means in reverse direction with respect to the feeding direction until the leading edge of the medium is aligned. By driving the feeding pinch in the reverse direction while feeding the medium towards this pinch, the medium will, by means of the degree of freedom that is introduced by the blouse means in the folder, automatically be aligned with the direction of the feeding pinch. If a medium arrives at the feeding pinch having a certain amount of skew with respect to the direction of the feeding pinch, the corners of the leading edge will not arrive at the reversely driven feeding pinch at the same time. By feeding the medium via the blouse means, towards the feeding pinch, the leading corner of the medium will be held at the feeding means until the complete leading edge of the medium arrives at the feeding means thereby aligning the leading edge with the feeding means.

In another embodiment, the feeding pinch of the folder is separated in several segments that are individually driven, or able to rotate at individually controllable speeds and the medium skew is corrected for by adapting the drive of the different segments of the feed means until the medium is aligned. This method enables a faster alignment of the medium as the medium can be transported through the feed means while the rotational speed of these feed means is adapted in reaction to a skew measurement. As the feed means do not have to be reversed, but their forward speed can be altered to correct for the medium skew, the transport time through the folder does not increase significantly due to the alignment step.

In another embodiment of the method according to the present invention, the medium is fed towards the folding cylinder at an angle with respect to the folding cylinder's normal in the plane of the medium feed. By feeding the medium at an angle with respect to the folding cylinder's normal no additional guides are necessary to guide the medium into the first pinch. Additional guides increase the complexity and volume of the folder.

In a further embodiment, the medium feed means are arranged such that the angle is fixed and feeds the leading edge of the medium towards the first folding pinch. The leading edge of the medium is guided into the first pinch such that the grip of the folding pinches can drive the medium in accordance with the folding program. When media are used that contains an amount of curl, for example as a result of the roll on which the medium is transported, this curl can be utilised to guide the leading edge of the medium into the first pinch.

In a second aspect, the invention relates to a folding apparatus, comprising a rotatable folding cylinder, a first and second rotatable press member capable of engaging with said folding cylinder to form a first and second folding pinch, and a medium feed means for feeding the medium towards the folding cylinder between said first and second folding pinches, wherein the folding apparatus comprises drive means which are able to alternate the rotational direction of the rotatable folding cylinder in operative state during a folding program.

A folding apparatus according to the present invention, that is configured to execute the method for folding as described, enables a very compact implementation of the folding construction.

In an embodiment of a folding apparatus according to the present invention, the folding apparatus comprises blouse means upstream from the medium feed means. The blouse means introduces a degree of freedom in the medium stream that enables a positional and skew correction of the medium. The blouse means introduces a buffer space to buffer the medium to bridge a difference between the input speed of the medium towards the folding apparatus and the feed speed into the folding apparatus, depending on the current folding program. Both speeds can be either continuous or stepwise.

In one embodiment, the folding apparatus comprises skew detection means. By detecting the skew in the medium flow, the alignment of the medium can be corrected. A good alignment of the medium results in a better-aligned fold.

In a further embodiment, the folding apparatus corrects for the detected medium skew in an operative state by means of the medium feed means. This correction can be executed by holding the medium or a part thereof while feeding the medium through the blouse means, until the medium is aligned, or alternatively, the feed means can be configured to drive parts of the medium at a different speed from other parts of the medium, thereby correcting the skew in the medium flow.

In another embodiment, the folding apparatus is placed in a vertical upright orientation. The medium flow that arrives in a horizontal orientation at the blouse means, is bent to a vertical orientation in the blouse means, i.e., the blouse curvature curves in the downward direction, where the medium flow is fed to the folding apparatus in this downward, vertical orientation. A length measurement can be carried out at the entrance of the folding apparatus or, e.g., by means of a communication with a printing system, either by wire, or wireless. The blouse means introduces a degree of freedom to correct for an initial misalignment of the medium, whereby the folder can make a correction. In this configuration there is no need for a large input table. This configuration enables the folder to be contained in a very small volume compared with folders that need a large horizontal input table. In an alternative embodiment the folder comprises means for communicating with the printer controller to determine the medium dimensions and measures the passing medium lengths during operation to correct for small deviations in the dimensions. Alternatively an operator can manually program the dimensions of the medium. In another embodiment the medium feed means are positioned in close proximity to the folding cylinder. If the folding apparatus corrects for the skew at the medium feed means and sequentially feeds the medium towards the folding cylinder, the alignment of the medium will be better preserved when it is aligned in close proximity to the folding cylinder. A better alignment results in a higher quality of the folds.

In a third aspect, the invention relates to a printing system comprising an in-line combination of a printing engine and a folding apparatus according to the present invention. An in-line combination of a printing engine and a folding apparatus is described as a combination in which the folding apparatus is configured to receive a medium from the printing engine and subsequently process it without the need to intermediately store the medium. Such an in-line combination enables an efficient processing of printed media that are to be folded. A folding program can easily take the printing properties into account to optimise the folding to the needs of the specific print.

In an embodiment of a printing system, according to the present invention, the exit of the printing engine or printing apparatus as a whole and the entrance of the folding apparatus are configured to be at approximately the same height to enable a transport of the medium from the printer to the folder.

It will be clear for the skilled person that a printing system as described can comprise a printing engine that is based on any printing process, such as, e.g., an inkjet printer, xerography, electro(photo)graphy, magnetography, or a hotmelt inkjet printer.

BRIEF DESCRIPTION OF THE DRAWINGS

The present invention will now be explained with reference to the following drawings, wherein.

DETAILED DESCRIPTION OF THE INVENTION

Figure 1:
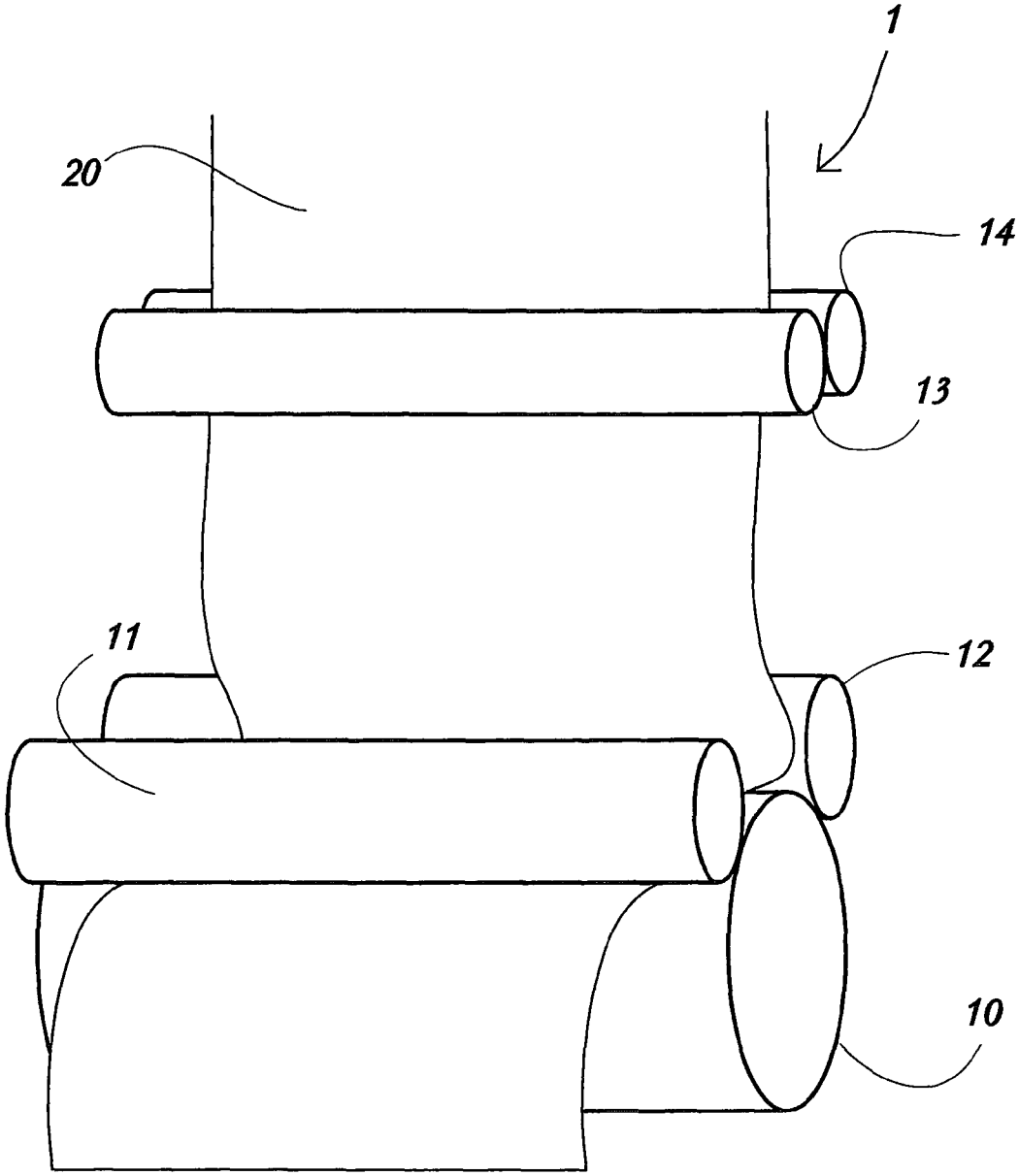
FIG. 1 is a schematic, perspective view showing a folder according to an embodiment of the present invention.

FIG. 1 shows a folder 1 according to the present invention. The folder 1 has a feed means 13, 14 to feed a medium 20 that is to be folded towards the folding means. Depending on the chosen folding program the medium 20 is folded in a fanfold, zigzag or c-fold configuration. To apply more folds to the medium 20, the medium can be re-fed into the folder 1 after finishing the folding program for the first time or the medium 20 can go through a plurality of folders 1 that are placed in sequence.

At the entrance 17, upstream of the medium folder 1, a sensor for determining the length of the medium, in the transport direction, is positioned, whereby the folding controller 60 can adapt the folding program to the specific needs corresponding to the dimensions of the inserted medium 20. In another embodiment (not shown) the folder communicates with the printer or printer controller to determine the dimensions of the medium that is to be folded.

Downstream of the feeding means 13, 14 a folding cylinder 10 is positioned. This folding cylinder 10 is driven by a motor (not shown). The motor is controlled by the folding controller 60 which executes a selected folding program for applying the desired folds to the medium 20. The folding cylinder 10 has two press members 11, 12 adjacent to its circumference. These press members 11, 12, for example press cylinders 11, 12, engage with the folding cylinder 10 to form a folding pinch between each of the press cylinders 11, 12 and the folding cylinder 10. The press cylinders 11, 12 are driven by a motor. In another embodiment (not shown) the press cylinders are freely rotatable.

The press cylinders are positioned on pivotable arms (not shown) to be able to vary the distance between the press cylinders 11, 12 and the folding cylinder 10 to cope with thick folded packages. The press cylinders 11, 12 are pressed against the folding cylinder 10 by means of a spring force.

During the folding operation the folding controller 60 takes into account the position of some of the significant parts of the mediums, such as the leading edge, the trailing edge and the location of the legend.

Figure 2:
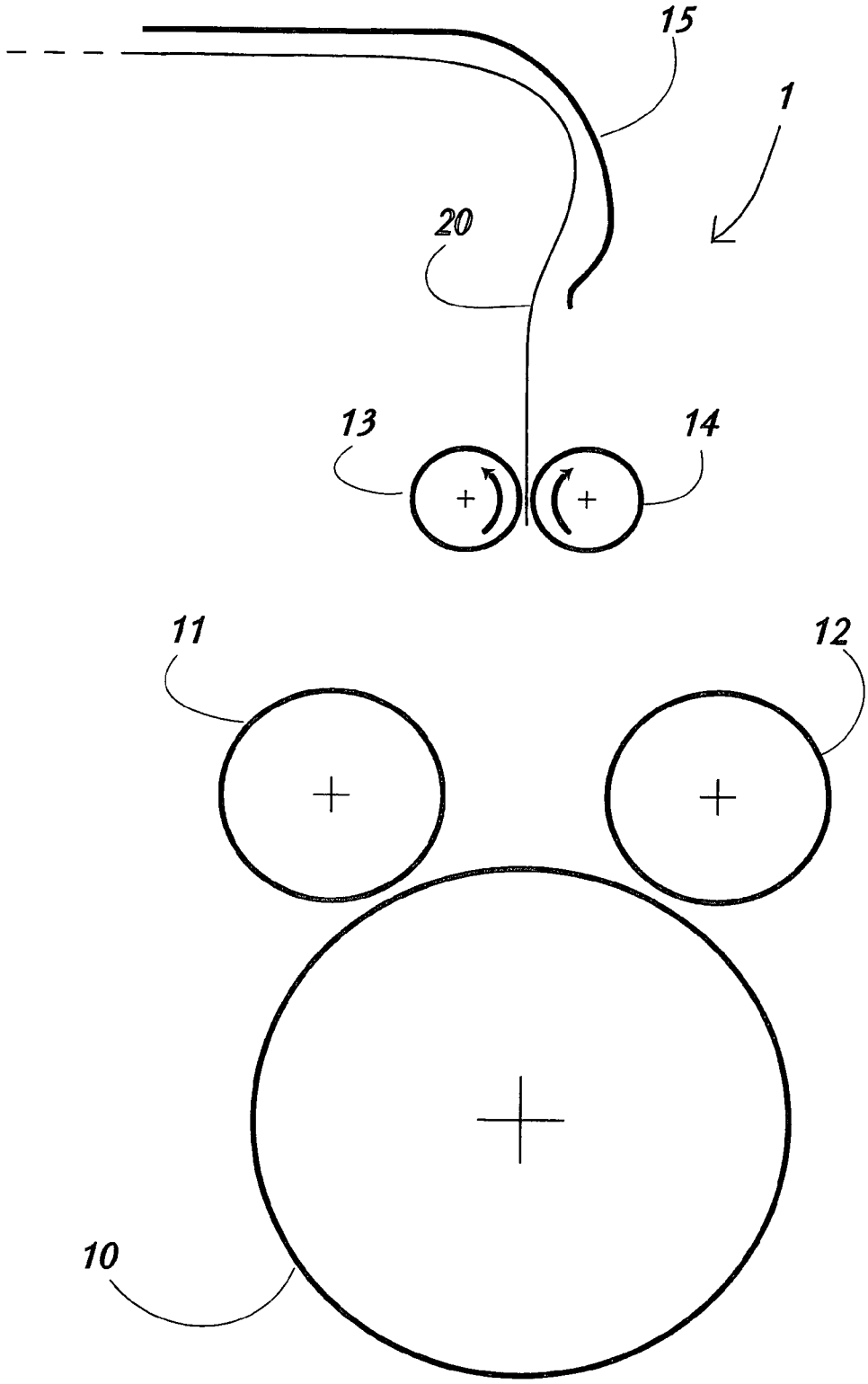
FIG. 2-8 show a step-by-step example of a fanfold, folding program in a folder according to an embodiment of the present invention.

In operation the folder 1 functions as follows; As shown in FIG. 2, the medium 20 is fed towards the feeding pinch 13, 14 via a blouse curvature 15. While feeding the leading edge of the medium 20 the feeding pinch 13, 14 is driven to rotate in the direction, opposite to the feeding direction. The medium 20 is fed through the blouse curvature 15 to the rotating feeding pinch 13, 14. By so doing the leading edge is aligned in a direction parallel to the axis of the feeding pinch rollers 13, 14. The misalignment of the medium 20 is corrected by the feeding of the medium and the rotation of the feeding pinch rollers 13, 14 in the direction opposite to the feeding direction. The necessary degree of freedom of the medium 20 therefore is introduced by the blouse curvature 15.

Figure 3:
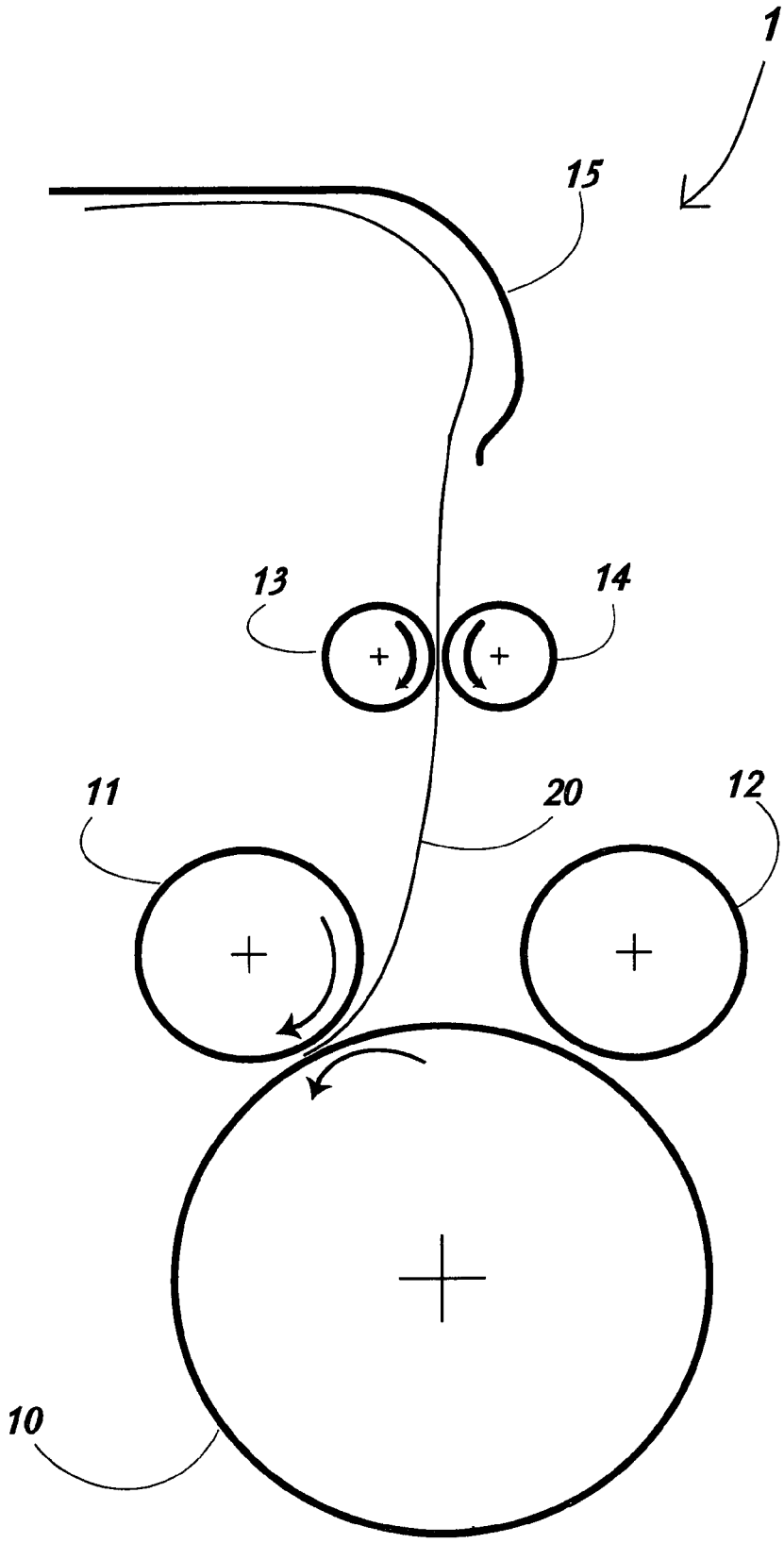

After the alignment of the medium, the feeding pinch is driven to rotate in the feeding direction as shown in FIG. 3 to thereby feed the medium towards the folding cylinder. The main folding cylinder 10 and the first press cylinder 11 are rotated in a first rotational direction to receive the medium 20 in the first folding pinch between the folding cylinder 10 and the first press cylinder 11. To prevent the medium 20 from being inserted in the wrong pinch, the second press cylinder 12 will rotate in the same rotational direction as the first press cylinder 11.

Figure 4:
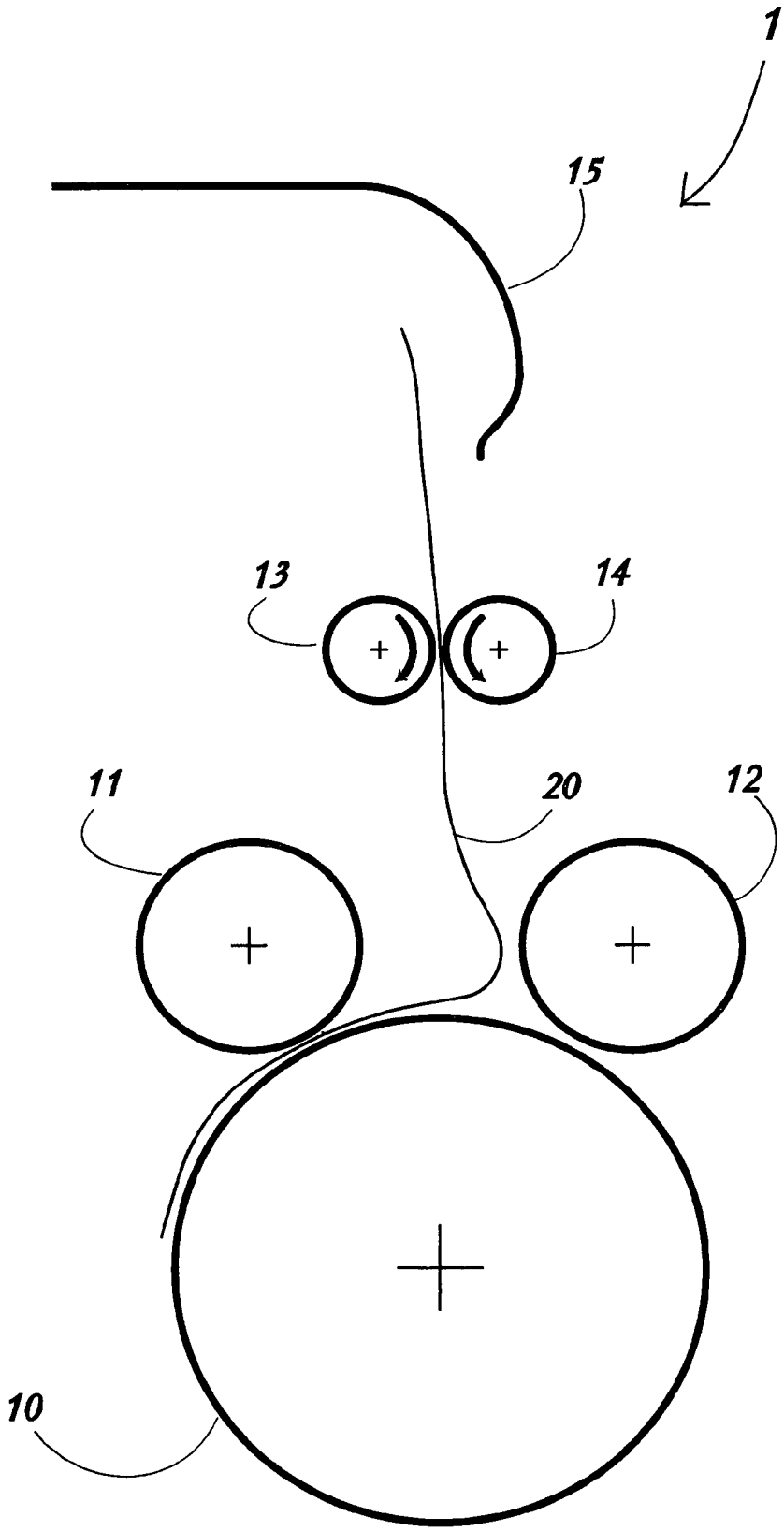

When the medium 20 enters into the first folding pinch the folding cylinder 10 and the first press cylinder 11 are stopped, while the feeding pinch 13, 14 continues feeding the medium 20 towards the folding cylinder 10 thereby forming a blouse in the medium 20 between the first and the second folding pinch, as shown in FIG. 4.

Figure 5:
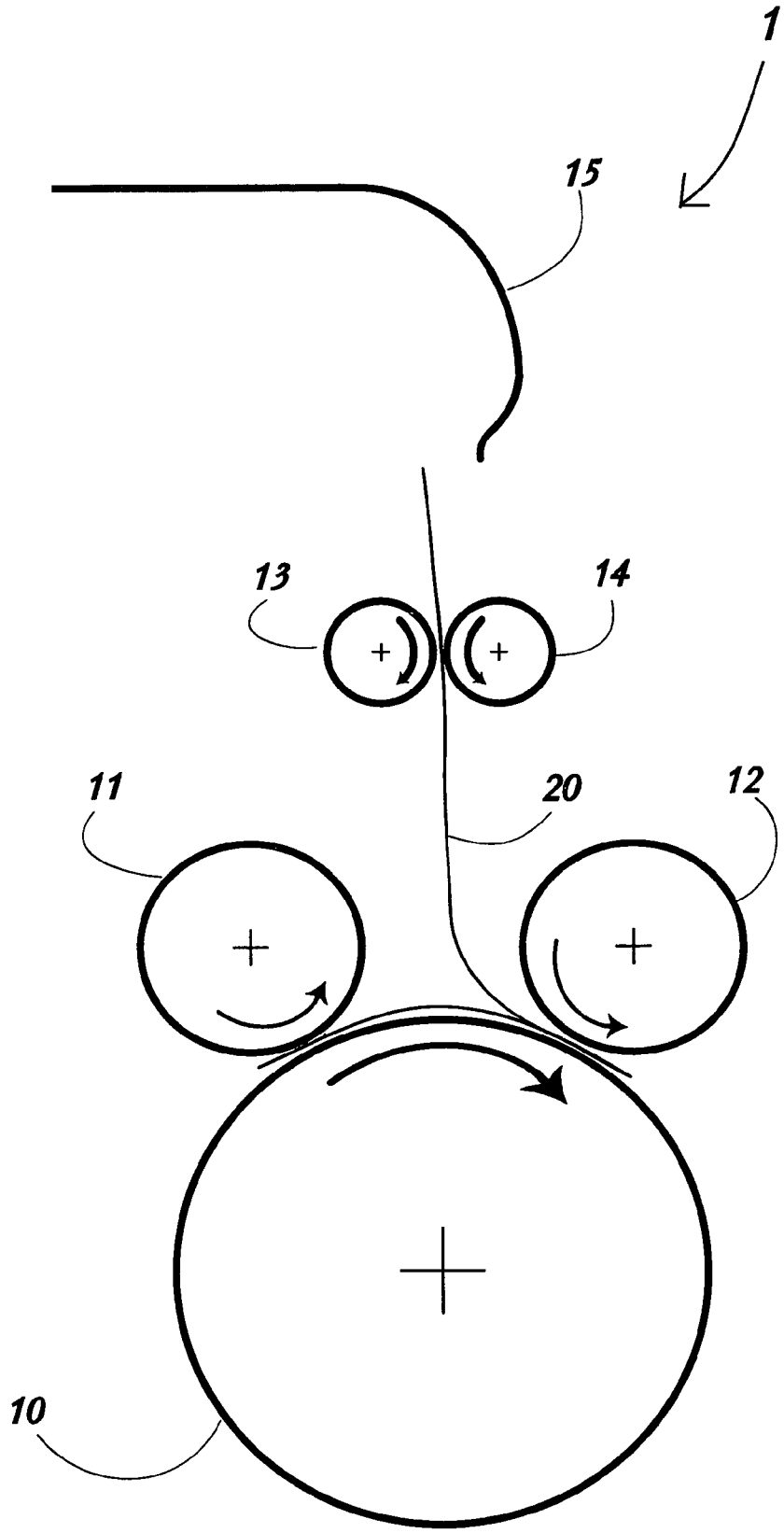

After forming the blouse in the medium 20, the folding cylinder 10 and the first press cylinder 11 as well as the second press cylinder 12 are driven in a second direction, opposite to the first rotational direction, as shown in FIG. 5. The feeding pinch 13, 14 continues feeding the medium 20 towards the folding cylinder 10. As a consequence of the rotation of the folding cylinder 10 and the press cylinders 11, 12 the blouse in the medium 20 is guided into the second folding pinch 12, thereby forming a first fold.

The folding controller 60 now determines whether to continue the folding program to form additional folds or to transport the folded medium towards the exit of the folder.

Figure 6:
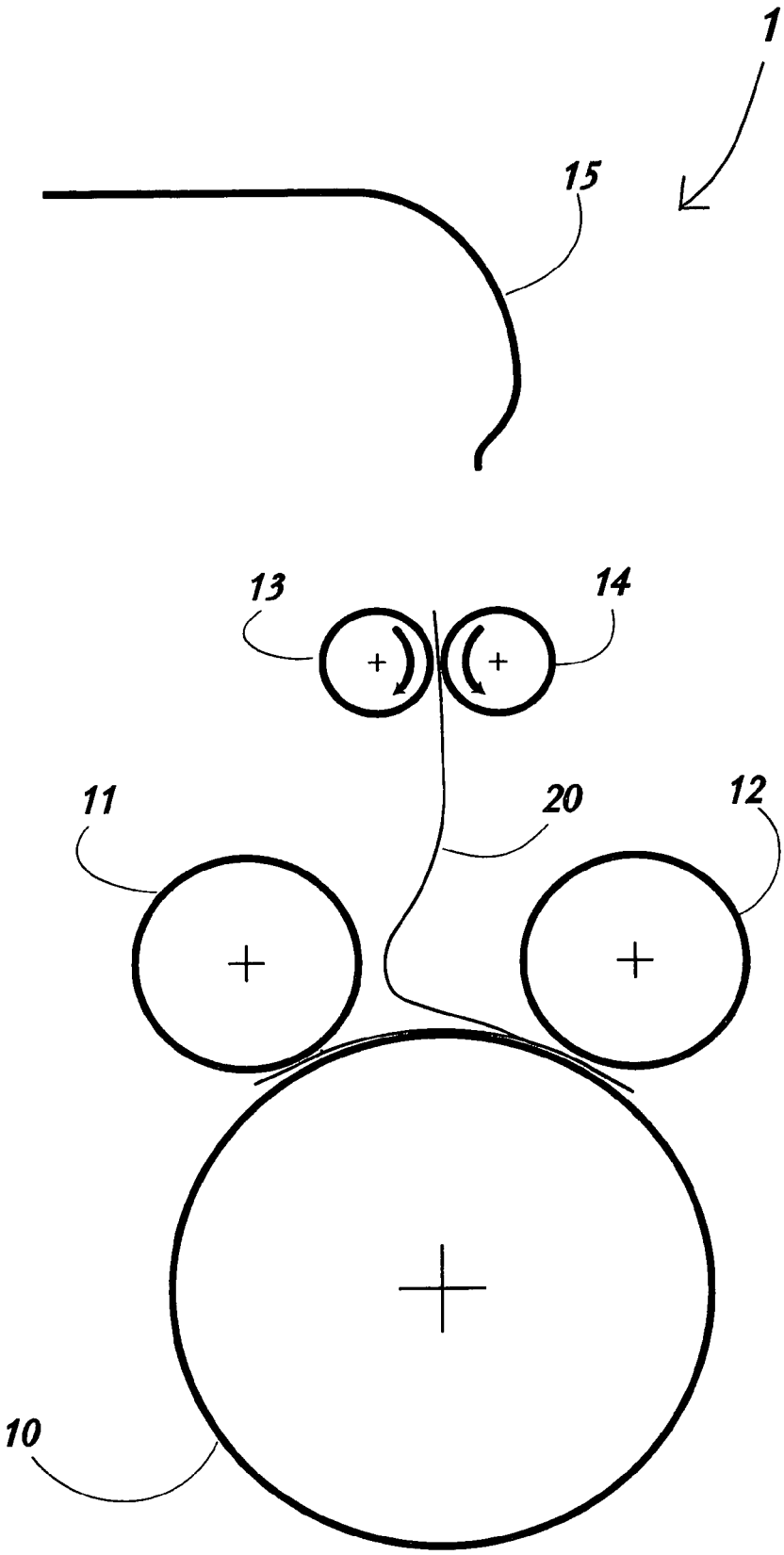
Figure 7:
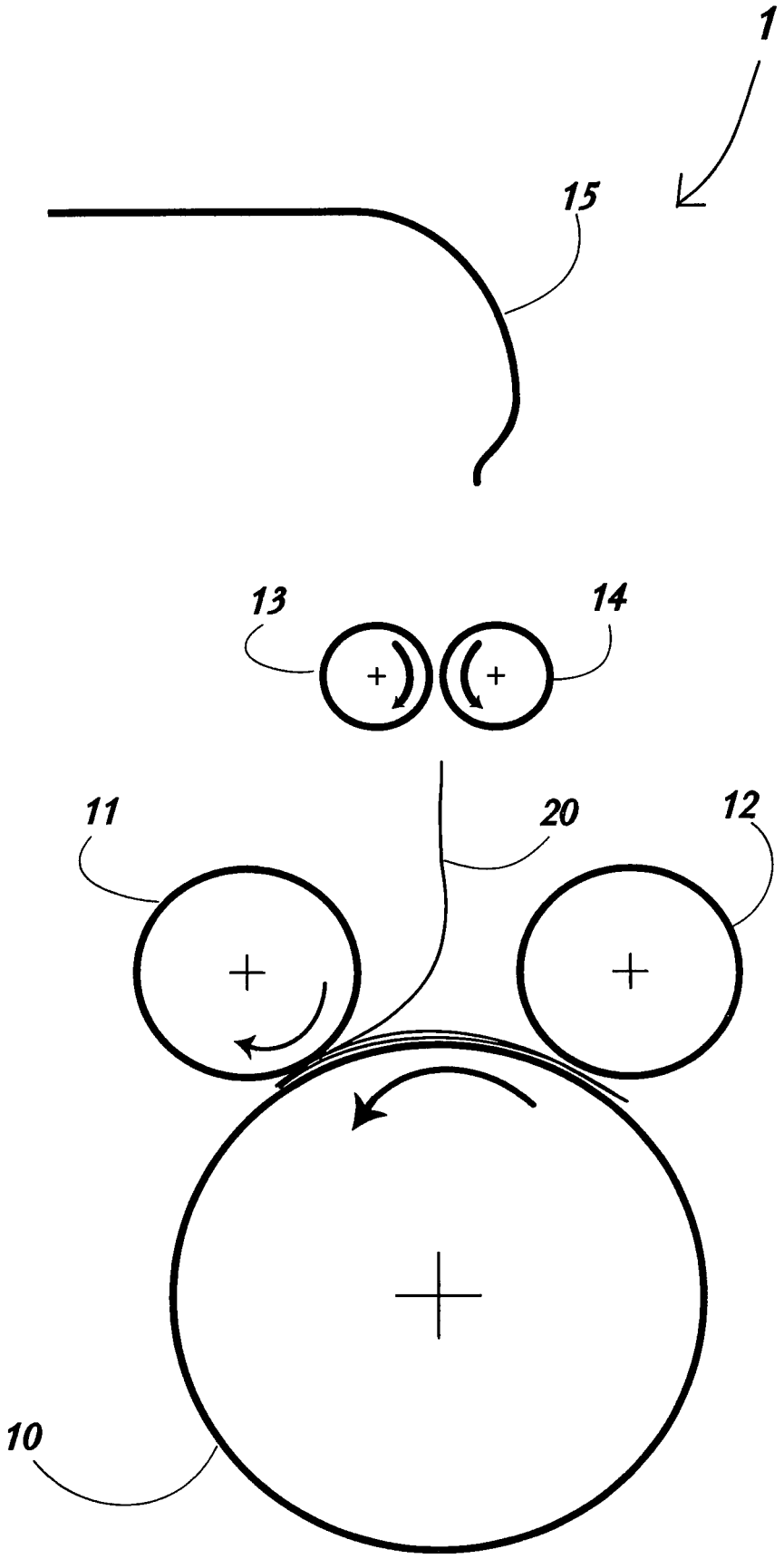

If an additional fold is to be made, the folding program continues as depicted in FIG. 6. The folding cylinder 10 and the press cylinders 11, 12 are stopped, while the feeding pinch 13, 14 continues to feed the medium 20 towards the folding cylinder 10, thereby forming a blouse in between the second and the first folding pinches.

After forming this blouse, the folding cylinder 10 and the press cylinders 11, 12 are driven in the first rotational direction again to move the blouse into the first folding pinch to form a second fold while the feeding pinch 13, 14 continues to feed the medium 20 towards the folding cylinder 10.

Figure 8:
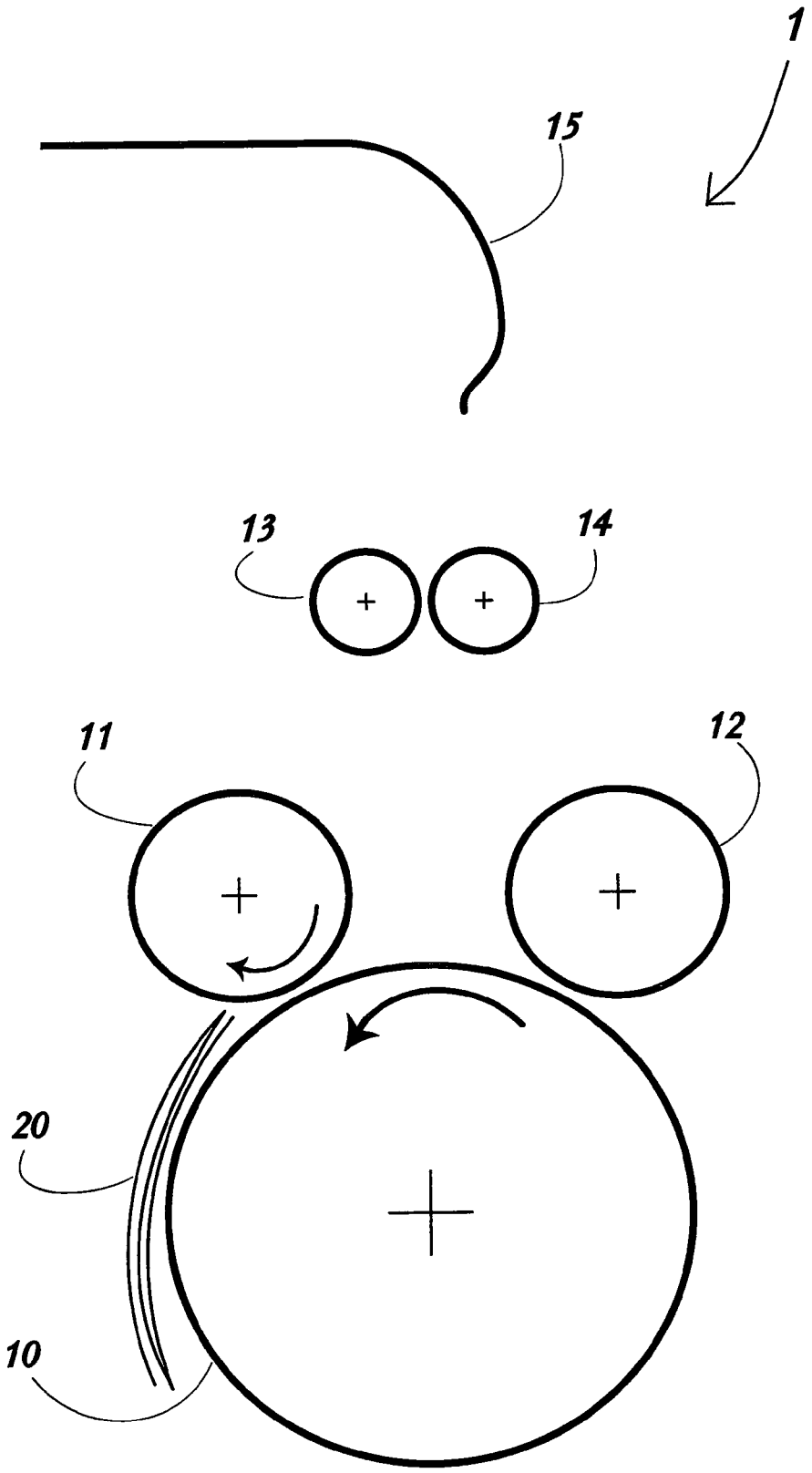

The folding controller 60 now determines whether to continue the folding program with an additional fold, which will be applied in analogy with the first fold or to eject the folded medium as shown in FIG. 8. The folded medium is ejected by rotating the folding cylinder 10 and, in this case, the first press cylinder 11 such that the folded medium is transported to the exit of the folder. Depending on the desired finishing and/or folding operations and the configuration, the folded package can be transported into a second folding or other finishing apparatus, or alternatively an operator can take the folded package out, or re-feed this package back into the folder for a folding operation in a direction perpendicular to the folds as described above.

Figure 9:
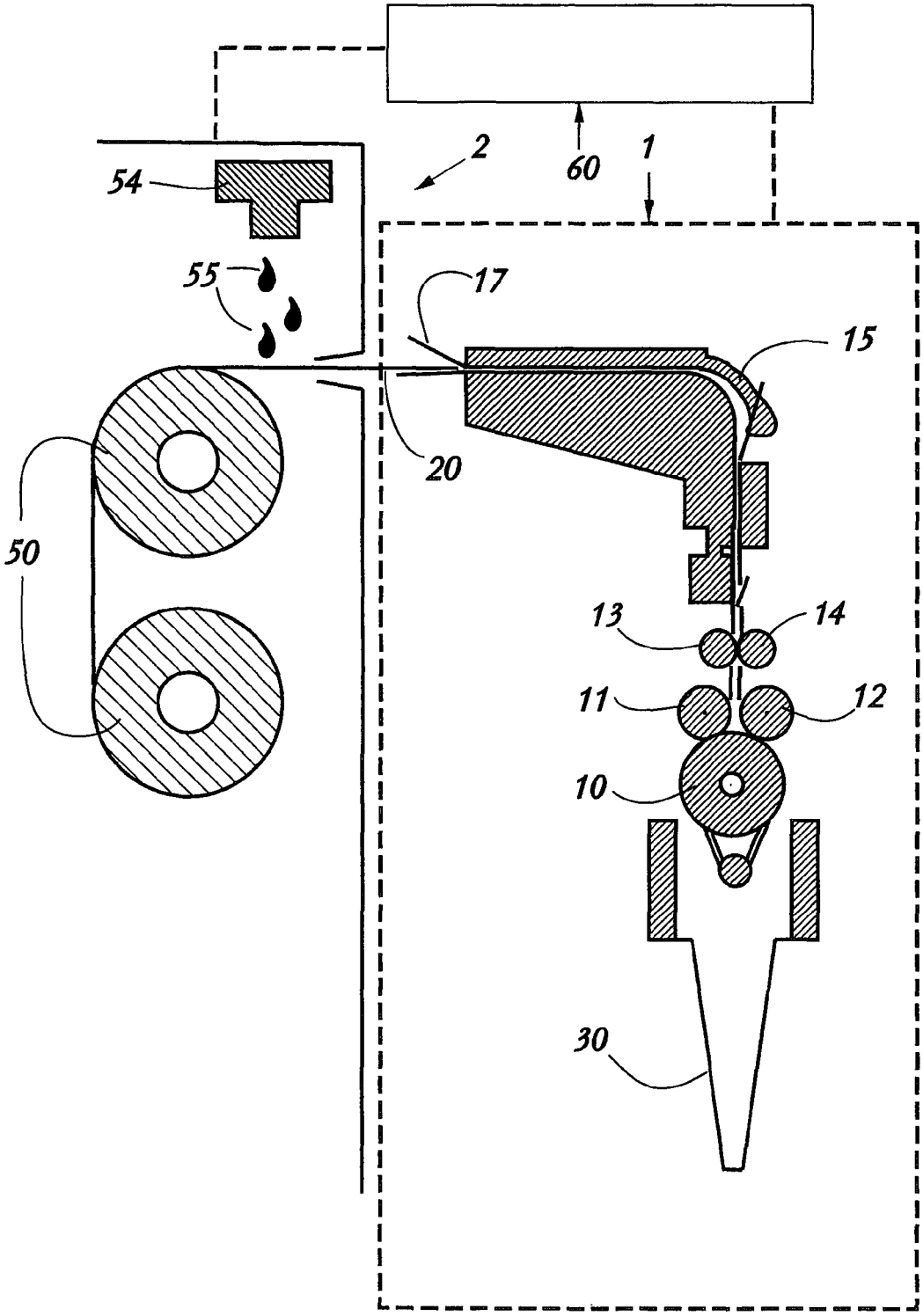
FIG. 9 is a schematic view of an in-line combination of a printing engine and a vertical upright configuration of a folding apparatus according to an embodiment of the present invention.

FIG. 9 is a schematic view of an in-line combination of a printing engine 2 and a vertical upright configuration of a folding apparatus 1 according to the present invention. A medium 20 is fed from one of the supply rolls 50 towards a printing engine. The printing engine is schematically depicted by inkjet head 54, jetting drops of ink 55 towards the medium 20 in an image-wise fashion. The in-line combination of the printer 2 and the folding apparatus 1 is configured such that the leading edge of medium 20 is transported from the exit of the printer 2 to the entrance 17 of the folder 1. The leading edge is fed through the blouse means 15 towards the medium feed means 13, 14. The feed means 13, 14 align the medium 20 and feed the medium 20 towards the folding cylinder 10 between press members 11 and 12. The folding program is executed as described above. After finishing the folding program the folded package is ejected into a collection part 30. This collection part transports the package that is folded in a zigzag fashion in one direction towards a second fold unit (not shown) to apply folds that extend in a direction perpendicular to the folds that are applied in folder 1. Alternatively the collection part 30 is formed as a collection tray such that an operator is able to take out the folded packages.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim.

The invention claimed is:

1. A method of folding a medium in a folding apparatus containing a rotatable folding cylinder, a first rotatable press member capable of engaging said folding cylinder to form a first folding pinch, a second rotatable press member, capable of engaging with said folding cylinder to form a second folding pinch, and a medium feed means, said method comprising the steps of:

a) feeding the medium with the medium feed means towards the folding cylinder and between the first and second pinch;

b) directing the medium into the first folding pinch formed by engaging said first rotatable press member with said folding cylinder, by rotating the folding cylinder in a first direction;

c) forming a blouse in the medium in between said feed means and the folding cylinder;

d) moving said blouse into said second pinch by rotating the folding cylinder in a second direction, opposite to the first direction, and correcting for medium skew prior to executing step a) by driving the feed means in a reverse direction with respect to the feeding direction until the leading edge of the medium is aligned.

2. The method according to claim 1 for forming a second fold in the medium which further comprises the steps of:

e) forming a blouse in the medium in between said feed means and the folding cylinder; and f) moving said blouse into said first pinch by rotating the folding cylinder in the first direction.

3. The method according to claim 1, wherein the skew correction is executed at the medium feed means.

4. The method according to claim 3, wherein the medium feed means are segmented and the skew correction is executed by adapting the drive of the different segments of the feed means until the medium is aligned.

5. The method according to claim 1, wherein the medium is fed towards the folding cylinder at an angle with respect to the folding cylinder's normal, in the plane of the medium feed.

6. The method according to claim 5, wherein the medium feed means are arranged such that the angle is fixed and feeds the leading edge of the medium towards the first folding pinch.

7. A folding apparatus, which comprises a rotatable folding cylinder, a first and second rotatable press member, each adapted to engage with said folding cylinder to form, respectively, a first and second folding pinch, and a medium feed means for feeding the medium towards the folding cylinder in between said first and second folding pinches, wherein the folding apparatus further comprises control means for controllably driving the drive means and alternating the rotational direction of the rotatable folding cylinder during a folding program and controllably driving the medium feed means to feed the medium during a folding program towards the folding cylinder and further includes skew detecting means, wherein the medium feed means, in an operative state are adapted to correct for the medium skew.

8. The folding apparatus according to claim 7, wherein the folding apparatus comprises blouse means provided upstream from the medium feed means.

9. The folding apparatus according to claim 7, wherein the medium feed means are positioned in close proximity to the folding cylinder.

10. A printing system comprising an in-line combination of a printing engine and the folding apparatus according to claim 7.

11. The method of claim 1, wherein the feed means is driven in the reverse direction through a blouse curve.

12. The device of claim 8, wherein the medium screw is corrected by driving the drive means in a reverse direction with respect to the feeding direction, through said blouse means.

13. A method of folding a medium in a folding apparatus containing a rotatable folding cylinder, a first rotatable press member capable of engaging said folding cylinder to form a first folding pinch, a second rotatable press member, capable of engaging with said folding cylinder to form a second folding pinch, a blouse curvature, and a medium feed means, said method comprising the steps of:

a) feeding the medium with the medium feed means towards the folding cylinder and between the first and second pinch;

b) directing the medium into the first folding pinch formed by engaging said first rotatable press member with said folding cylinder, by rotating the folding cylinder in a first direction;

c) forming a blouse in the medium in between said feed means and the folding cylinder;

d) moving said blouse into said second pinch by rotating the folding cylinder in a second direction, opposite to the first direction, and correcting for medium skew prior to executing step a) by driving the feed means in a reverse direction with respect to the feeding direction until the leading edge of the medium is aligned, and e) using the blouse curvature to introduce a buffer space to affect medium speed.

* * * * *